US006679573B2

(12) United States Patent
Bienick

(10) Patent No.: US 6,679,573 B2
(45) **Date of Patent: *Jan. 20, 2004**

(54) REFRIGERATOR SHELF

(75) Inventor: Craig Bienick, Jenison, MI (US)

(73) Assignee: Gemtron Corporation, Sweetwater, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/165,958

(22) Filed: Jun. 11, 2002

(65) Prior Publication Data

US 2002/0149304 A1 Oct. 17, 2002

Related U.S. Application Data

(62) Division of application No. 09/834,896, filed on Apr. 16, 2001, now Pat. No. 6,422,673.

(51) Int. Cl.[7] ..... A47B 96/02; F25D 25/02

(52) U.S. Cl. ..... 312/408; 62/382

(58) Field of Search ..... 312/401, 404, 312/408, 410, 351; 211/15; 108/27, 108; 62/382

(56) References Cited

U.S. PATENT DOCUMENTS

| | | | | |
|---|---|---|---|---|
| 1,119,982 A | | 12/1914 | Ohnstrand | |
| 2,169,295 A | | 8/1939 | Shuart | |
| 3,912,085 A | | 10/1975 | Cooke et al. | |
| 4,223,983 A | | 9/1980 | Bloom | |
| 4,503,780 A | | 3/1985 | Apissomian | |
| 4,805,541 A | | 2/1989 | Drane et al. | |
| 5,059,016 A | | 10/1991 | Lawassani et al. | |
| 5,404,828 A | | 4/1995 | Tesney | |
| 5,440,857 A | | 8/1995 | Shanok et al. | |
| 5,516,204 A | * | 5/1996 | Calvert et al. | 312/408 |
| 5,830,552 A | | 11/1998 | Meier et al. | |
| 6,045,101 A | | 4/2000 | Goyette et al. | |

FOREIGN PATENT DOCUMENTS

| | | |
|---|---|---|
| DE | 9004180 | * 9/1991 |
| EP | 507455 | * 10/1992 |
| FR | 2663112 | * 12/1991 |

* cited by examiner

*Primary Examiner*—James O. Hansen
(74) *Attorney, Agent, or Firm*—Diller, Ramik & wight

(57) ABSTRACT

A shelf includes a one-piece open frame made of molded synthetic material and a piece of glass closing an opening of the frame. Each of opposite side frame portions are defined by an upper wall, a side wall and at least one finger with the opposing fingers being spaced from each other and each defining with an associated upper wall a glass piece side edge-receiving channel. The glass piece is snapped into the glass piece side edge-receiving channels. The fingers slide upon the ledges whereby product loading upon the glass piece which might cause the fingers to inadvertently deform and release the glass piece side edges is effectively resisted to preclude inadvertent glass piece/frame disassembly under load.

44 Claims, 6 Drawing Sheets

REFRIGERATOR SHELF

CROSS-REFERENCE TO RELATED APPLICATION

This application is a divisional application of Ser. No. 09/834,896 filed on Apr. 16, 2001, and now U.S. Pat. No. 6,422,673.

BACKGROUND OF THE INVENTION

Adjustable shelves are commonly associated with both the freezer compartment and the fresh food compartment of conventional side-by-side refrigerators. When the shelves are constructed as sliding shelves, opposite generally parallel side edges of the shelves rest upon and slide relative to horizontally aligned ribs or grooves formed in opposing pairs in the side walls of the freezer compartment, the fresh food compartment or both or inner liners thereof. Typical of such shelves and shelving, both sliding and cantilevered, are disclosed in the following patents:

Ohnstrand (U.S. Pat. No. 1,119,982) discloses a glass slab 3 which sits upon "a filler 7 of suitable material, as cement" (page 1, lines 52–53). A ledge 1 of an annular frame or "truss flange 2" (page 1, line 40) supports the entire shelf. Note that the edge of the glass slab 3 is not sandwiched between the margin 6 and the ledge 1. The glass slab 3 is basically "dropped-in" from above, not snapped-in from below.

Goyette et al. (U.S. Pat. No. 6,045,101) and Donaghy (U.S. Pat. No. 4,960,308) disclose somewhat more up-dated versions of the same type shelf structure, the first being a shelf or table top in which a sheet of glass 18 is slid into opposite channels of a frame and then is locked into position, as shown in FIGS. 7 and 8 (Goyette et al.), and a crisper drawer in which a panel 21 (FIG. 4 of Donaghy) is dropped-in from above and rests upon a flange 31, respectively.

Also, cited but not considered pertinent to this application are U.S. Pat. Nos. 2,169,295; 3,912,085; 4,223,983; 4,503,780; 4,805,541; 5,059,016; 5,404,828; 5,440,857; and 5,830,552.

Typically of all of these patents is the provision of a shelf formed by adhesively bonding a peripheral edge of a sheet of glass to an underlying continuous flange of an annular frame, as is best illustrated in FIG. 1 of the Ohnstrand patent. The cost of adhesive adds to the overall cost of such shelves and, of course, additional steps are required during the assembly process to apply the adhesive to the frame and/or to the edges of the glass panel prior to assembling the same. Moreover, if an overabundance of adhesive is utilized, there is a tendency for the edges of the glass panel to squeeze excess adhesive out of the continuous peripherally inwardly opening glass edge-receiving channel, and this in turn creates additional adhesive clean-up problems and the cost associated therewith. The frames of such shelves are also relatively thick and since peripherally continuous both above and below the peripheral edge of the glass panel, the conductivity is proportionally reduced by the area of the edge of the glass panel totally peripherally encapsulated by the plastic frame. Such lessening of conductivity increases the costs of operation and varies the temperature through the refrigerator compartment, whereas a more uniform temperature throughout the compartment is highly desirable.

Such conventional shelves formed from a piece of tempered glass and a frame, be the frame formed of a single piece of synthetic polymeric/copolymeric plastic material or metal, each include a relatively wide and/or thick frame as measured normal to any edge of the glass panel. The frame is particularly wide at its bottom wall to effectively underlyingly support the entire peripheral edge of the piece of glass and thereby prevent the glass from "popping" out of the frame when the glass is placed under heavy product loading. Obviously, the thicker and wider the frame, including upper and lower walls thereof and a bight portion therebetween collectively defining a glass edge-receiving channel, the less efficient the conductivity when in use and the less efficient the cost of manufacture due to the added cost of the plastic or metallic material of the frame.

Such conventional sliding shelves also normally utilize a locking mechanism or a latching mechanism to prevent the shelf from being inadvertently pulled completely outwardly of the refrigerator compartment. Normally, such a latching or locking mechanism includes movable cooperative stops or latches which must be manually operated to move the sliding shelf between various selected positions. Obviously, such movable latching mechanisms which are not normally part of the shelf frame and are added thereto as a separate component create an additional cost and thereby increase the price of the shelf including the final cost of the refrigerator to a consumer.

BRIEF SUMMARY OF THE INVENTION

A novel refrigerator compartment constructed in accordance with this invention includes substantially parallel side walls, a rear wall therebetween, and a plurality of vertically spaced shelf-supporting ledges in the form of channels or ribs along each of the side walls. A sliding shelf is defined by a one-piece open frame made of substantially homogeneous polymeric/copolymeric synthetic material and a piece of tempered glass or a glass panel closing an opening defined by the frame. The open frame includes opposite substantially parallel side frame portions and opposite substantially parallel front and rear frame portions with the frame including a continuous peripheral upper wall and a continuous depending peripheral wall. The depending peripheral wall at each side frame portion includes an inwardly projecting finger with the fingers being generally aligned and collectively defining a glass-receiving channel with the peripheral upper wall.

The fingers and specifically a terminal-free end of each finger is relatively resilient and the dimensioning of the width of the glass panel and the distance between the opposing fingers is such that the glass panel can be snap-secured along its side edges into the side edge-receiving channels of the frame. Similar additional opposing fingers can be provided along the side frame portions of the frame and at least one each in opposing relationship along the rear and front edges of the frame. If symmetrically located relative to the frame, these fingers provide mid point bottom support for the glass panel along each of its side edges, its rear edge and its front edge. Most importantly, the fingers of the side frame portions slide upon and are supported by the refrigerator compartment side wall ribs or channels which effectively resist any tendency of the glass panel edges to snap outwardly of the fingers in a downward direction under product loading of the glass panel. In this manner, a sliding shelf is manufactured at a relatively low cost from only two pieces of material (a frame and a glass panel) in the absence of the added costly manufacturing step of applying adhesive and removing excess adhesive, while at the same time increasing conductivity because the fingers cover but minor lower surface areas of the glass panel side, front and rear edges.

In further accordance with the invention, the side walls of the refrigerator compartment also include upwardly projecting latching or abutment fingers or groove portions which cooperate with fingers and/or notches of the shelf frame to achieve locking or latching of the sliding shelf in a rearward most and a forward most position to thereby preclude inadvertent/accidental removal of the sliding shelf from within the refrigerator compartment.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIGS. 3, 4 and 5, is a fragmentary cross-sectional view of the assembled frame and glass panel of FIG. 9, and illustrates adhesive bonding a continuous peripheral upper wall and one of a plurality of fingers to a front edge of the tempered glass panel.

DETAILED DESCRIPTION OF THE INVENTION

Figure 1:
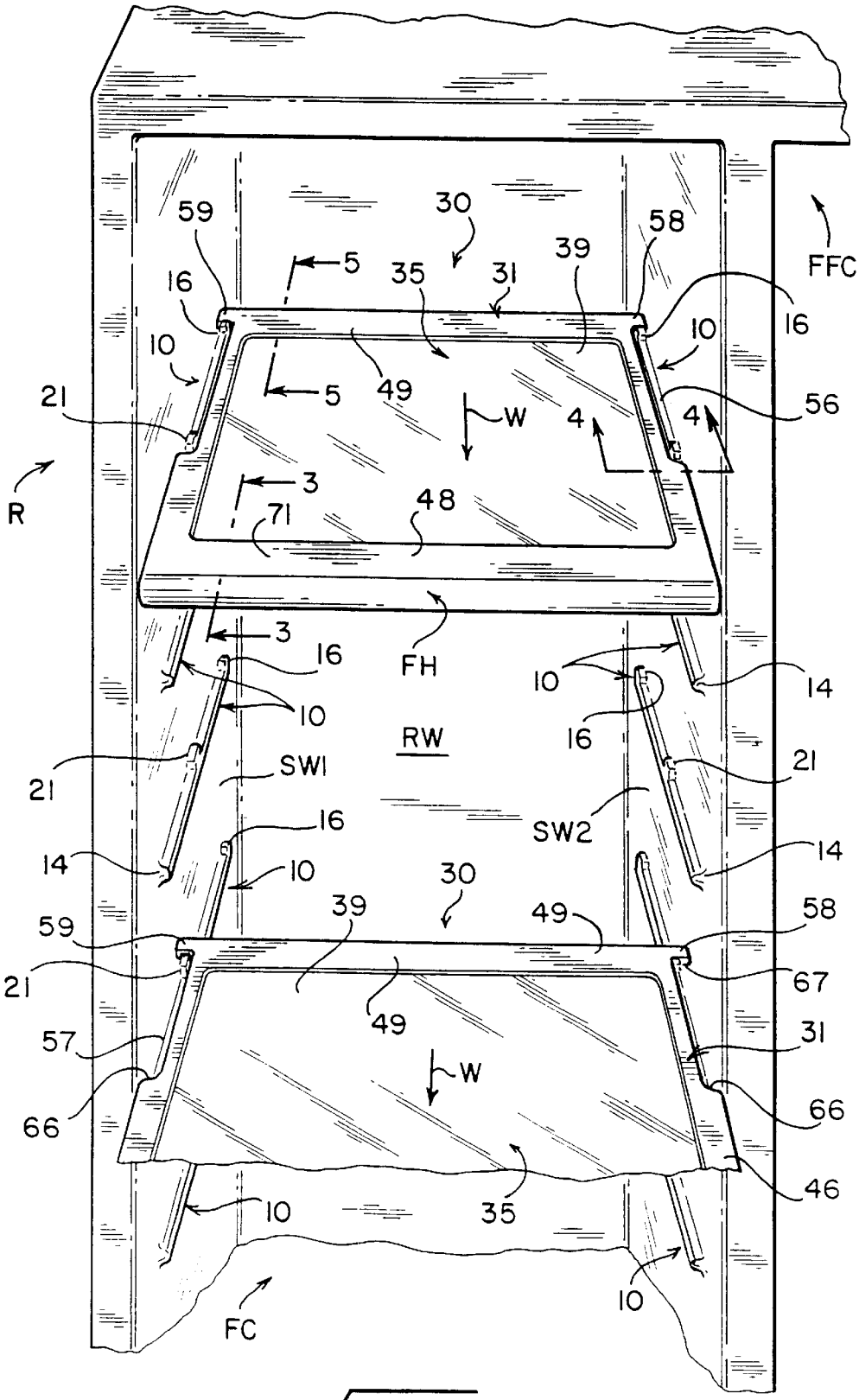
FIG. 1 is a fragmentary front perspective view of a refrigerator, and illustrates a fresh food compartment, a freezer compartment and two shelves in the freezer compartment in two different positions relative to underlying supporting ribs or ledges.
Figure 2:
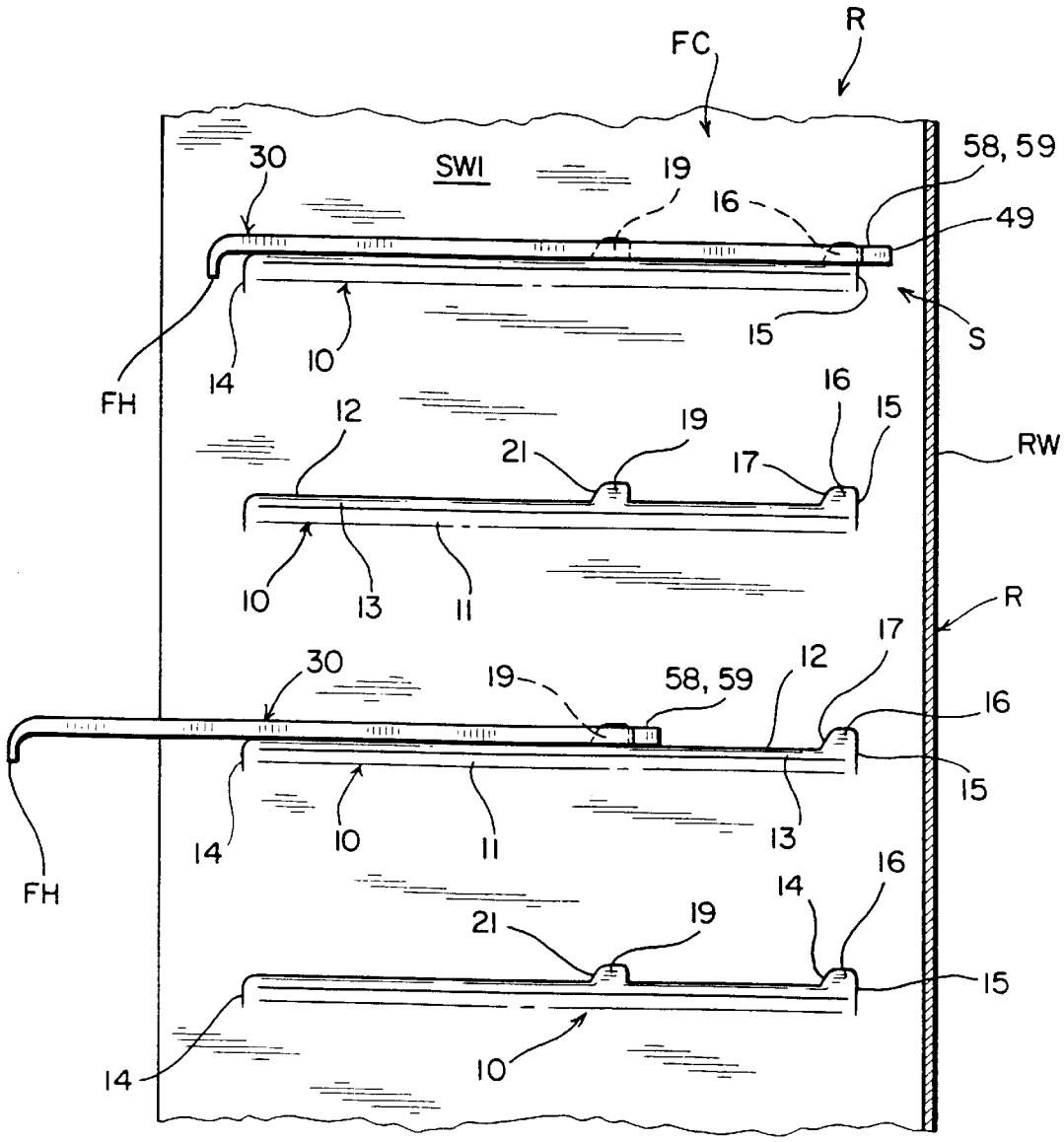
FIG. 2 is an enlarged fragmentary vertical cross-sectional view through the freezer compartment of FIG. 1, and more clearly illustrates the two shelves in their two positions and the manner in which sliding movement to the left from each illustrated position is precluded.
Figure 4:
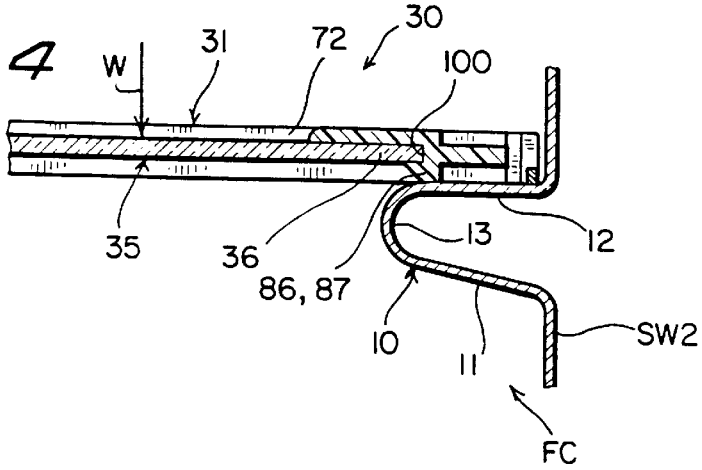
FIG. 4 is a fragmentary enlarged cross-sectional view taken generally along line 4—4 of FIG. 1, and illustrates a similar finger of a side frame portion of the frame being underlyingly supported by a rib or ledge of the associated side wall.
Figure 4A:
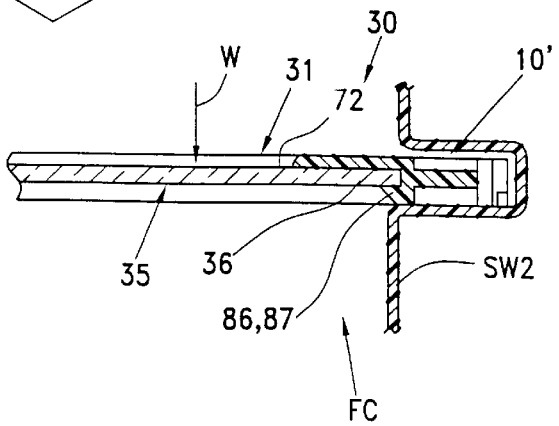
FIG. 4*a* is a fragmentary enlarged cross-sectional view taken generally along line 4—4 of FIG. 1, and illustrates a similar finger of a side frame portion of the frame being underlyingly supported by a channel of the associated side wall.

A refrigerator R (FIG. 1) includes a fresh food compartment FFC and a freezer compartment FC. The freezer compartment FC includes a back or rear wall RW and opposite generally parallel side walls SW1 and SW2, each of which includes a plurality of vertically spaced ledges or ribs 10. Opposite ribs 10 project toward each other in associated pairs in a common horizontal plane, and each rib 10 includes a lower wall 11, an upper wall 12 and a bight wall 13 therebetween (FIG. 4). Each rib 10 further includes an entrance end 14 (FIGS. 1 and 2) and a rear end 15 which is spaced from the rear wall RW (FIG. 2) and includes an upstanding back latch, stop or abutment 16 having a forward cam face 17. Each rib 10 also includes a medial upstanding stop latch or abutment 19 having a similar cam face 21. The stops or abutments 16, 19 cooperate with any one of a plurality of identical shelves 30 in the manner to be described more fully hereinafter. In lieu of opposite ribs 10 (FIG. 4), opposite channels 10' (FIG. 4*a*) open toward each other in associated pairs in a common horizontal plane.

Figure 6:
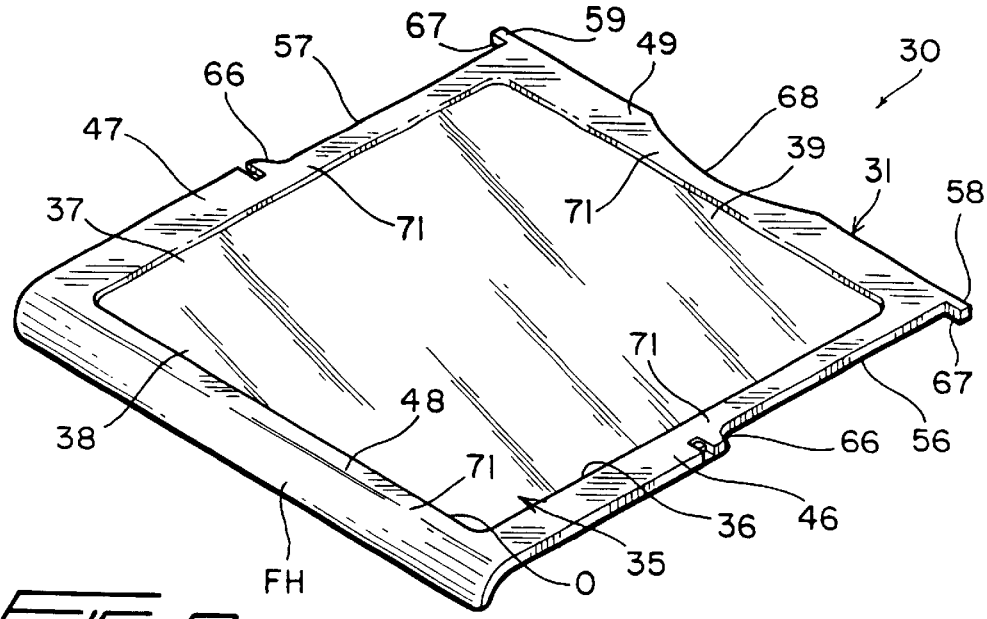
FIG. 6 is a top perspective view of the shelf of this invention, and illustrates a piece of tempered glass or a tempered glass panel bounded by a substantially one-piece homogeneous injection molded frame of polymeric/copolymeric material.
Figure 7:
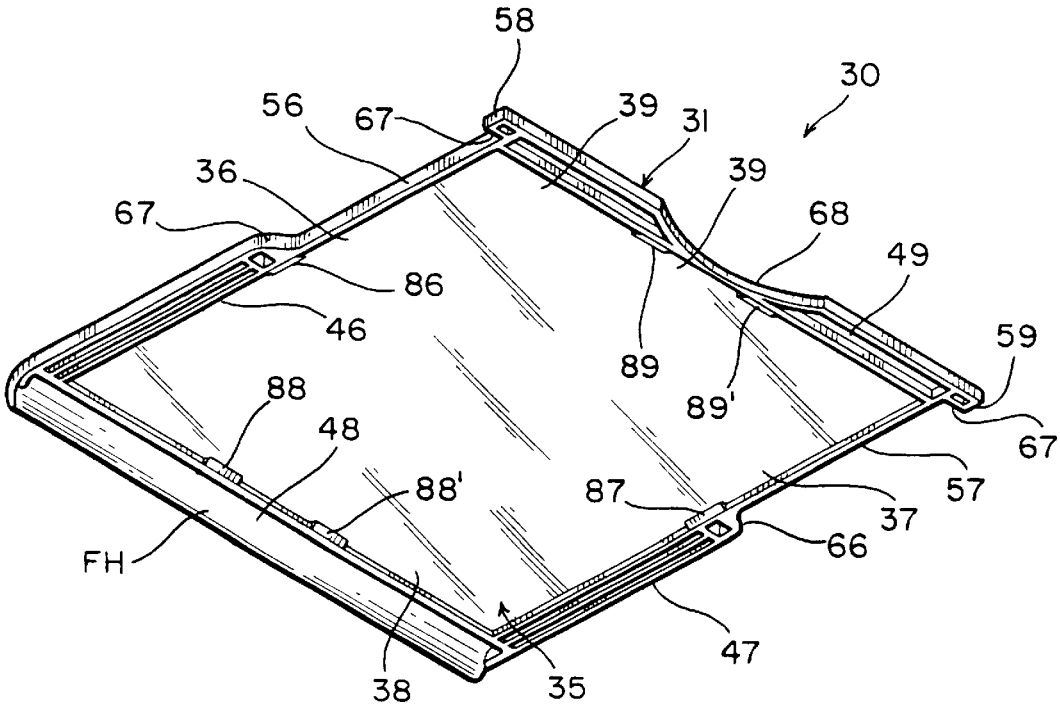
FIG. 7 is bottom perspective view of the shelf of FIG. 6, and illustrates a single glass side edge supporting finger associated with each side frame portion of the frame, and a pair of front and rear glass edge-supporting fingers associated with respective front and rear frame portions of the frame.

Each shelf 30 (FIGS. 1, 3, 4, 6, 7 and 8) includes a one-piece open frame 31 injection molded from substantially homogeneous polymeric/copolymeric synthetic plastic material and a piece of tempered glass or a tempered glass panel or pane 35 having opposite side edges 36, 37 (FIGS. 6 and 7) substantially parallel to each other and generally parallel respective front and rear edges 38 and 39.

The open frame 31 of the shelf 30 further includes substantially parallel side frame portions 46, 47, a front frame portion 48 which curves downwardly to form a front handle FH and a rear frame portion 49. In the assembled condition of the frame 30, the side edges 36, 37, the front edge 38 and the rear edge 39 of the glass panel 35 are each snap-secured to the respective side frame portions 46, 47, the front frame portion 48 and the rear frame portion 49 of the frame 31.

The side frame portions 46, 47 include respective elongated oppositely opening side slots or notches 56, 57 which terminate adjacent the rear frame portion 49 at oppositely projecting locking or latching projections 58, 59, respectively. The locking projections 58, 59 selectively lock behind and abut against the stops 16 of the ribs 10 when the shelves 30 are in their "home" or fully inserted position in the freezer compartment FC, as is illustrated by the uppermost shelf 30 in FIGS. 1 and 2, and also abut against the upstanding latches or abutments 19 when any shelf 30 is partially slid forwardly or outwardly of the freezing compartment FC, as is illustrated by the lowermost shelf 30 of FIGS. 1 and 2 of the drawings. The latter described abutting relationship between the locking projections 58, 59 and the latches or locks 16, 19 of the ribs 10 prevent the shelves 30 from being inadvertently slid outwardly from either of the two positions of the two shelves 30 best illustrated in FIGS. 1 and 2. For example, in order to slide the uppermost shelf 30 in FIGS. 1 and 2 forwardly, the rear frame portion 49 must be lifted upwardly to permit the projections 58, 59 to clear the projections 16 thereby allowing the uppermost shelf 30 to be slid from the position illustrated to the position of the lowermost shelf illustrated in FIGS. 1 and 2 at which the projections 58, 59 abut the stops 19 thereby precluding inadvertent or accidental removal beyond the position of the illustrated lower shelf 30 in FIGS. 1 and 2. The lowermost shelf 30 can only be slid to the left further than that illustrated by once again intentionally lifting the rear frame portion 49. In addition, each of the side slots 56, 57 include opposing abutment faces 66, 67 (FIGS. 6 and 8) which in the position of the upper shelf 30 of FIG. 2 contact the cam faces 21 of the projections 19 and the rear end 15 of the side ribs 10 thereby preventing the upper shelf 30 of FIGS. 1 and 2 from being moved to the left or the right without lifting the rear frame portion 49 of the frame 31 sufficiently to clear the projections 16, 16 and/or 19, 19. The relative immobility of the upper shelf 30 of FIGS. 1 and 2 assures that a space S (FIG. 2) will be maintained between the rear frame portion 49 of each shelf 30 and the rear wall RW of the freezer compartment FC which enhances the conductivity and circulation of cold air within the freezer compartment FC. A rearwardly opening generally concave notch 68 (FIGS. 6 and 8) is also formed in each rear frame portion 49 of each frame 31 to further enhance air flow and conductivity within the freezer compartment FC.

Figure 3:
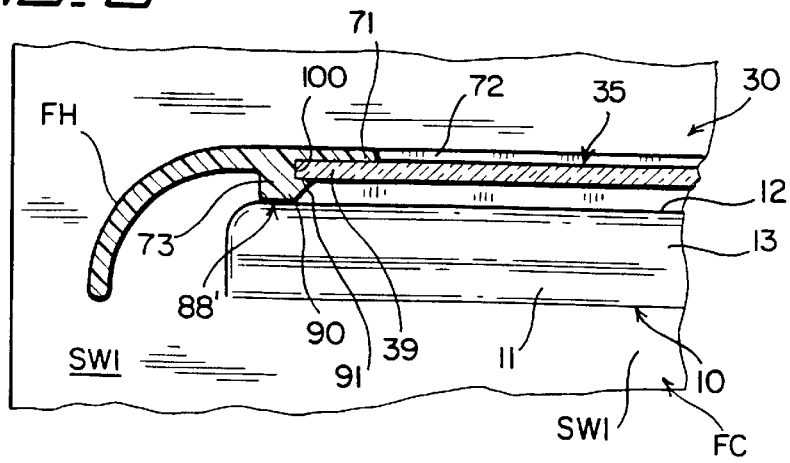
FIG. 3 is an enlarged fragmentary cross-sectional view taken generally along line 3—3 of FIG. 1, and illustrates the manner in which a peripherally continuous upper wall, a peripherally continuous depending peripheral wall and a relatively short underlying finger defined a front edge-receiving channel of a frame housing a front edge of a tempered glass panel.
Figure 9:
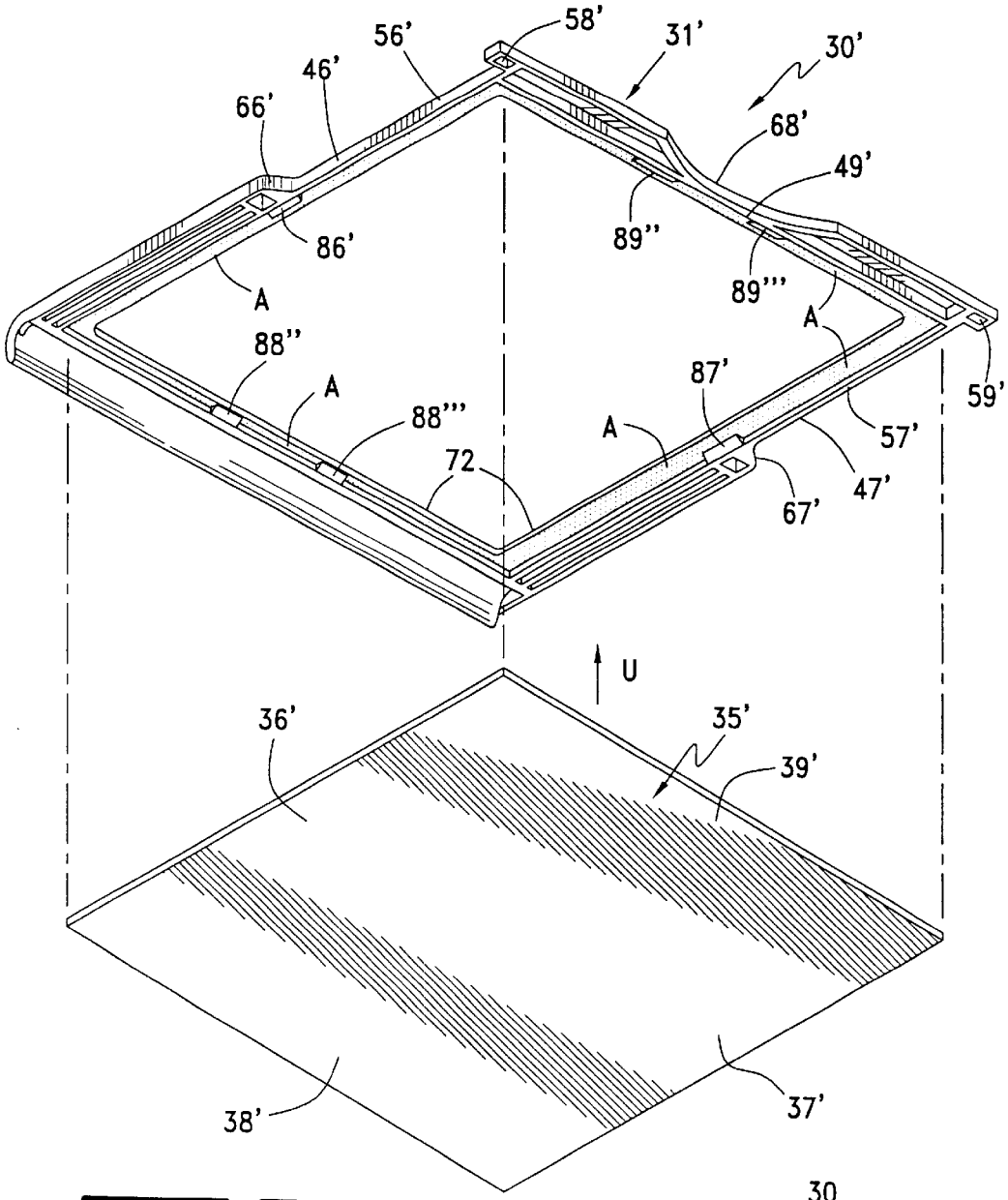
FIG. 9 is an exploded perspective view of another sliding shelf identical to the shelf of FIG. 8, and illustrates adhesive applied to the frame, including associated fingers, incident to snap-securing a tempered glass panel to the frame.
Figure 8:
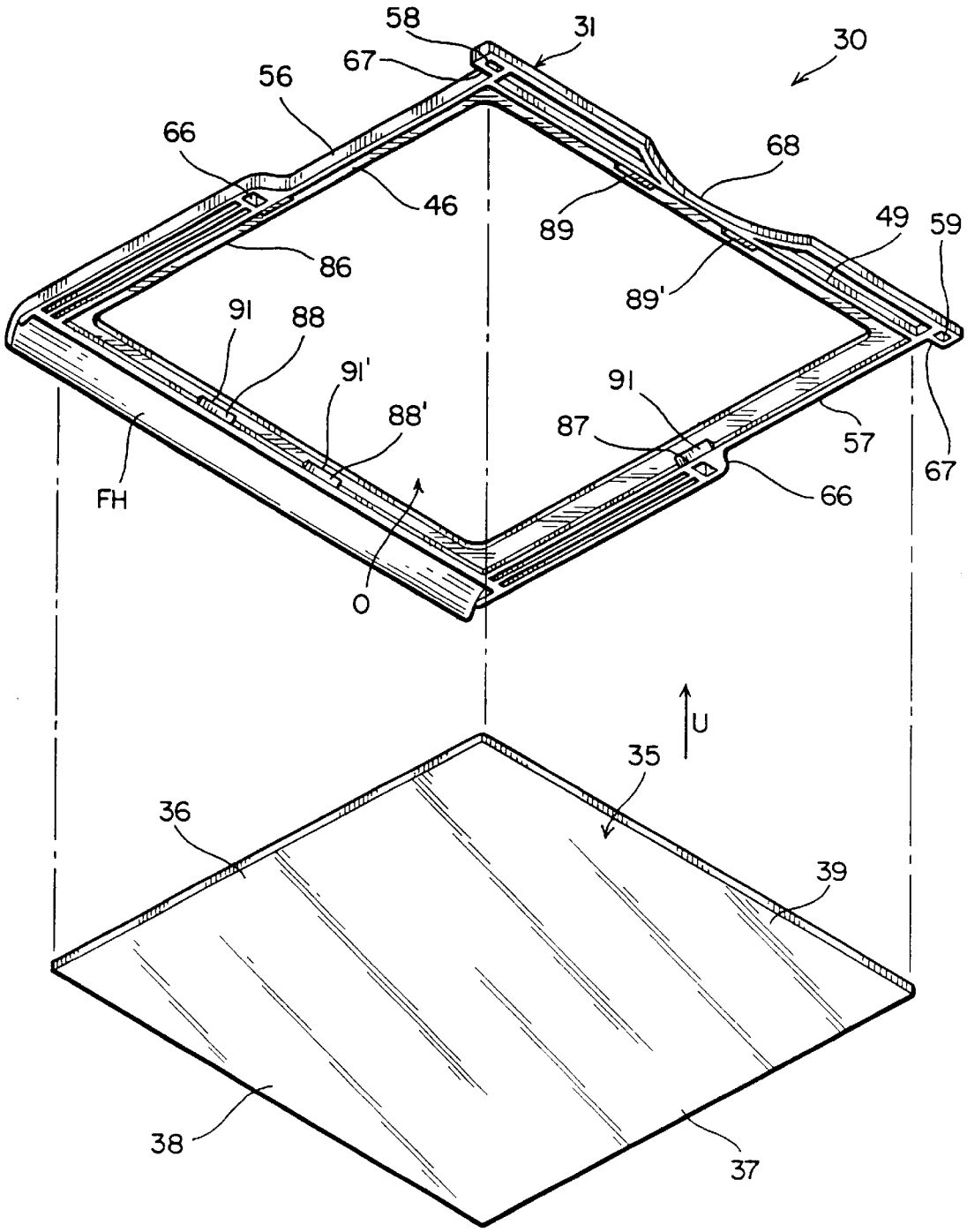
FIG. 8 is a perspective view of the frame and glass panel of the shelf of FIGS. 6 and 7, and illustrates the components prior to the snap-securement of the glass panel into the frame in a direction from the bottom thereof absent the utilization of adhesive.

The open frame 31 of each shelf 30 includes an upper peripherally continuous wall 71 having an inboard or innermost edge 72 which defines an opening 0 (FIGS. 6 and 9) of the frame 31. A depending peripherally continuous peripheral wall 73 (FIGS. 3 and 4) depends from the upper wall 71 and is peripherally coextensive therewith and thereby defines a generally depending continuous peripheral skirt. The depending continuous peripheral wall or skirt 73 has associated therewith inwardly directing fingers associated with the frame portions 46 through 49 of the frame 31. As is best illustrated in FIG. 8, a single finger 86 is associated with the side frame portion 46, a single finger 87 is associated with the side frame portion 47, two spaced fingers 88, 88' are associated with the front frame portion 48 and two rear fingers 89, 89' are associated with the rear frame portion 49. Each finger 86 through 89' includes a short leg 90 which is relatively thin and resilient and terminates in a terminal free edge 91. Each leg 90 of each finger 86 through 89' defines with the defending peripheral wall 73 and the upper peripheral wall 71 a glass edge-receiving channel 100 (FIGS. 3 and 4). Therefore, there is a glass edge-receiving channel 100 associated with each of the fingers 86 through 89'.

As is apparent from and illustrated in FIGS. 3, 4 and 8, the distance between opposite terminal free edges 36, 37 and 38, 39 of the glass panel 35 are appreciably greater than the corresponding distances between opposite portions of the peripheral edge 72 of the upper wall 71, whereby the upper wall 71 appreciably overlies the side edges 36 through 39 of the glass panel 35 along the upper surface (unnumbered) thereof, as is readily apparent from FIGS. 3 and 4 of the drawings. However, the distance between the terminal free ends 91 of the pairs of opposing fingers 86, 87; 88, 89; and 88', 89' (FIGS. 7 and 8) is each slightly less than the distance across opposite terminal free edges of the glass panel 35. Due to this relative dimensioning and the relatively flexible nature of the fingers 90 and the finger terminal edge portions 91 thereof, the latter are free to temporarily flex and deform as the glass panel 35 is inserted upwardly, as is indicated by the arrow U in FIG. 8, which causes the fingers 87 through 89' to temporarily deform, resulting in the edges 36 through 39 of the glass panel 35 to essentially pass or snap into the associated channels 100 of each finger 87 through 89' whereupon the finger terminal free edge portions 91 rebound to their original position and interlock beneath each glass edge 36 through 39, as is most evident in FIGS. 3 through 4 of the drawings. In this manner, each shelf 30 is constructed of only two pieces of material, namely, the one-piece injection molded frame 31 and the tempered glass panel 35 retained in snap-secured relationship to each other by means of the channels 100 of each of the fingers 86 through 89'.

It is to be particularly noted that even though the side frame portions 46, 47 include but a single respective finger 86, 87, each of the fingers 86, 87 rests and slides upon and is supported by the upper walls 12 of the guide ribs 10, as is best illustrated in FIG. 4 in which the finger 86 is supported and slides upon the upper wall 12 of the rib 10. The latter is an important characteristic of the present invention because the underlying support of the upper wall 12 of each rib 10 provided each finger 86, 87 assures that each finger 86, 87 and the terminal free end 91 thereof will not distort under product loading, as is diagrammatically indicated by a weight W in FIGS. 1 and 4 resting upon the glass panel 35. If unsupported by the upper walls 12 of the opposite ribs 10, the side fingers 86, 87 would tend to deflect appreciably under the weight or load W and the glass panel 35 might inadvertently flex the fingers 86, 87 sufficient to escape the side channels 100 which in turn might cause the entire glass panel 35 to drop downwardly out of the closed opening O of the frame 31 or might stress sufficiently to crack. However, by the support afforded the side fingers 86, 87, the tendency of these fingers to inadvertently deform and release the glass panel 35 is effectively resisted to preclude inadvertent glass panel/frame disassembly under load. Each shelf 30 is thereby capable of being manufactured at relatively low cost absent complexities of design or additive separate components, though in further accordance with this invention, a similar shelf 30' can be constructed in the manner illustrated in FIGS. 9 and 10 of the drawings.

Figure 10:
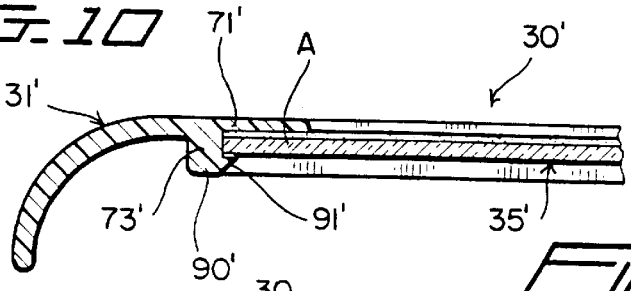
FIG. 10, which appears on the sheet of the drawing containing
Figure 5:
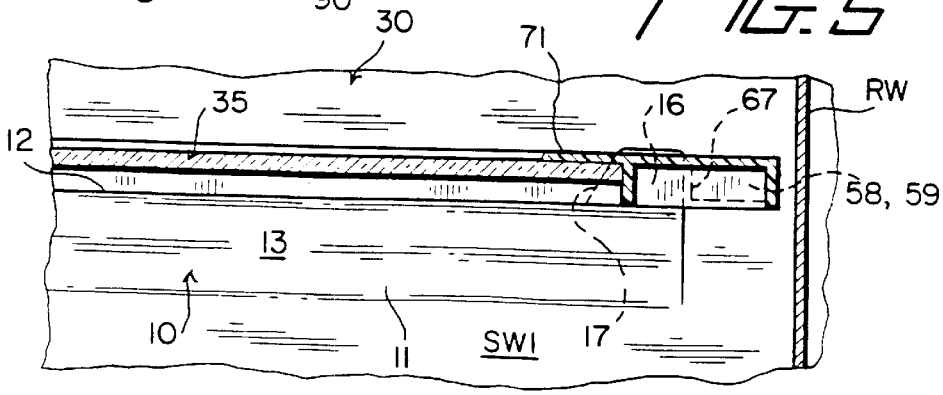
FIG. 5 is a fragmentary enlarged cross-sectional view taken generally long line 5—5 of FIG. 1, and illustrates a "home" latched position of the upper shelf of FIG. 1.

The shelf 30' is identical to the shelf 30 and all identical portions thereof are identically numbered, though primed. The major differences between the shelf 30, 30' is the absence of any adhesive or bonding material associated with the shelf 30, whereas the shelf 30' may include a coating of adhesive A (FIGS. 9 and 10) completely along the underside of an upper wall 71' or a coating of adhesive A' (FIG. 10) upon each of the fingers 86' through 89" thereof, or both adhesives A, A', as is best illustrated in FIG. 10. In most situations, no adhesive whatever is required, as in the case of the shelf 30, and even under relatively high loading W of the glass panel 35 under load, a minor amount of adhesive A' could be associated only with the side fingers 86', 87' but may also be associated with the front fingers 88''', 88$^{iv}$ and the rear fingers 89''' and 89$^{iv}$.

Although a preferred embodiment of the invention has been specifically illustrated and described herein, it is to be understood that minor variations may be made in the apparatus without departing from the spirit and scope of the invention, as defined the appended claims.

What is claimed is:

1. A refrigerator shelf comprising a one-piece open frame made of substantially homogeneous polymeric/ copolymeric molded synthetic material and a piece of glass closing an opening defined by said frame; said open frame having opposite substantially parallel side frame portions and opposite substantially parallel front and rear frame portions; said glass piece having opposite substantially parallel side edges and opposite substantially parallel front and rear edges; said side, front and rear frame portions being substantially contiguous to said respective side, front and rear edges; each of said side frame portions being defined by an upper wall, a side wall depending from each upper wall and a lower wall projecting from its side wall toward an opposite side wall with the opposing lower walls being spaced from each other and each defining with an associated upper wall a glass piece side edge-receiving channel, each upper wall and lower wall having a terminal free edge, said glass piece side edges being spaced a predetermined distance from each other, said upper wall terminal free edges being spaced a predetermined distance from each other, said lower wall terminal free edges being spaced a predetermined distance from each other, the predetermined distance of the glass piece side edges being appreciably greater than the predetermined distance of said upper wall edges and only slightly greater than the predetermined distance between said lower wall terminal free edges whereby said glass piece side edges are captively retained in said glass piece side edge-receiving channels, and each lower wall including a relatively resilient end edge portion which temporarily deflects and subsequently rebounds to snap-secure said glass piece side edges in said glass piece side edge-receiving channels.

2. The refrigerator shelf as defined in claim 1 wherein said frame and glass piece are devoid of a bond therebetween.

3. The refrigerator shelf as defined in claim 2 wherein each lower wall defines a relatively narrow finger.

4. The refrigerator shelf as defined in claim 1 wherein said frame and glass piece are devoid of adhesive therebetween.

5. The refrigerator shelf as defined in claim 4 wherein each lower wall defines a relatively narrow finger.

6. The refrigerator shelf as defined in claim 1 wherein said frame and glass piece include a bond therebetween.

7. The refrigerator shelf as defined in claim 6, wherein each lower wall defines a relatively narrow finger.

8. The refrigerator shelf as defined in claim 1, wherein said frame and glass piece include an adhesive therebetween.

9. The refrigerator shelf as defined in claim 8, wherein each lower wall defines a relatively narrow finger.

10. The refrigerator shelf as defined in claim 1, wherein said front frame portion and said rear frame portion are each defined by an upper wall, a side wall depending from each upper wall and a lower wall defining with its associated latter-mentioned upper wall a glass piece front edge-receiving channel and a glass piece rear edge-receiving channel; each said rear frame portion and front frame portion upper wall and lower wall having a terminal free edge, said glass piece front and rear edges being spaced a predetermined distance from each other, said front frame portion rear and frame portion upper wall terminal free edges being spaced a predetermined distance from each other, said front frame portion and rear frame portion lower wall terminal free edges being spaced a predetermined distance from each other, the predetermined distance of the glass piece front and rear edges being appreciably greater than the predetermined distance of said upper wall edges and only slighter greater than the predetermined distance between said front frame portion and rear frame portion terminal free edges whereby said glass piece front and rear edges are captively retained in said glass piece front and rear edge-receiving channels, and at least one of said front frame portion and rear frame portion lower walls includes a relatively resilient end edge portion which temporarily deflect deflects and subsequently rebounds to snap-secure at least one of said glass piece front and rear edges in a respective one of said front edge-receiving channel and said rear edge-receiving channel.

11. The refrigerator shelf as defined in claim 10, wherein said frame and glass piece are devoid of a bond therebetween.

12. The refrigerator shelf as defined in claim 11, wherein each lower wall defines a relatively narrow finger.

13. The refrigerator shelf as defined in claim 10, wherein said frame glass piece are devoid of adhesive therebetween.

14. The refrigerator shelf as defined in claim 13, wherein each lower wall defines a relatively narrow finger.

15. The refrigerator shelf as defined in claim 10, wherein said frame and glass piece include a bond therebetween.

16. The refrigerator shelf as defined in claim 15, wherein each lower wall defines a relatively narrow finger.

17. The refrigerator shelf as defined in claim 10, wherein said frame and glass piece include an adhesive therebetween.

18. The refrigerator shelf as defined in claim 17, wherein each lower wall defines a relatively narrow finger.

19. The refrigerator shelf as defined in claim 10, wherein each lower wall defines a relatively narrow finger.

20. The refrigerator shelf as defined in claim 1, wherein said lower wall of said at least one side frame portion defines at least one finger, a further finger spaced from an said one finger of and defining with its associated upper wall a further glass piece side edge-receiving channel of said at least one side frame portion, and each further finger having a terminal free edge and a relatively resilient end edge portion corresponding structurally and dimensionally to said one finger to further snap-secure said at least one glass piece side edge in said further glass piece side edge-receiving channel.

21. The refrigerator shelf as defined in claim 20, wherein each lower wall defines a relatively narrow finger.

22. The refrigerator shelf as defined in claim 1, wherein each lower wall defines a relatively narrow finger.

23. A refrigerator shelf comprising a one-piece open frame made of substantially homogeneous polymeric/copolymeric molded synthetic material and a piece of glass closing an opening defined by said frame; said open frame having opposite substantially parallel side frame portions and opposite substantially parallel front and rear frame portions; said glass piece having opposite substantially parallel side edges and opposite substantially parallel front and rear edges; said side, front and rear frame portions being substantially contiguous to said respective side, front and rear edges; each of said side frame portions being defined by an upper wall, a side wall depending from each upper wall and a lower wall projecting from its side wall toward an opposite side wall with the opposing lower walls being spaced from each other and each defining with an associated upper wall a glass piece side edge-receiving channel, each upper wall and lower wall having a terminal free edge, said glass piece side edges being spaced a predetermined distance from each other, said upper wall terminal free edges being spaced a predetermined distance from each other, said lower wall terminal free edges being spaced a predetermined distance from each other, the predetermined distance of the glass piece side edges being appreciably greater than the predetermined distance of said upper wall edges and only slightly greater than the predetermined distance between said lower wall terminal free edges whereby said glass piece side edges are captively retained in said glass piece side edge-receiving channels, and at least one lower wall of at least one of said front and rear frame portions including a relatively resilient end edge portion which temporarily deflects and subsequently rebounds to snap-secure one of said glass piece front and rear edges in the glass piece edge-receiving channel of said at least one front and rear frame portion.

24. The refrigerator shelf as defined in claim 23, wherein said frame and glass piece include a bond therebetween.

25. The refrigerator shelf as defined in claim 23, wherein said frame and glass piece include an adhesive therebetween.

26. The refrigerator shelf as defined in claim 23, wherein said at least one lower wall defines a relatively narrow finger.

27. The refrigerator shelf as defined in claim 26, wherein said frame and glass piece include a bond therebetween.

28. The refrigerator shelf as defined in claim 26, wherein said frame and glass piece include an adhesive therebetween.

29. The refrigerator shelf as defined in claim 23, wherein said at least one lower wall defines a relatively narrow finger of said front frame portion.

30. The refrigerator shelf as defined in claim 23, wherein said at least one lower wall defines a relatively narrow finger of said rear frame portion.

31. A refrigerator shelf comprising a one-piece open frame made of substantially homogeneous polymeric/copolymeric molded synthetic material and a piece of glass closing an opening defined by said frame; said open frame having opposite substantially parallel side frame portions and opposite substantially parallel front and rear frame portions; said glass piece having opposite substantially parallel side edges and opposite substantially parallel front and rear edges; said side, front and rear frame portions being substantially contiguous to said respective side, front and rear edges; each of said side frame portions being defined by an upper wall, a side wall depending from each upper wall and a lower wall projecting from its side wall toward an opposite side wall with the opposing lower walls being spaced from each other and each defining with an associated upper wall a glass piece side edge-receiving channel, each upper wall and lower wall having a terminal free edge, said glass piece side edges being spaced a predetermined distance from each other, said upper wall terminal free edges being spaced a predetermined distance from each other, said lower wall terminal free edges being spaced a predetermined distance from each other, the predetermined distance of the glass piece side edges being appreciably greater than the predetermined distance of said upper wall edges and only slightly greater than the predetermined distance between said lower wall terminal free edges whereby said glass piece side edges are captively retained in said glass piece side edge-receiving channels, and at least one lower wall of at least two of said front, rear and side frame portions including a relatively resilient end edge portion which temporarily deflects and subsequently rebounds to snap-secure two of said glass piece edges in the glass piece edge-receiving channel of said at least two frame portions.

32. The refrigerator shelf as defined in claim 31, wherein said frame and glass piece include a bond therebetween.

33. The refrigerator shelf as defined in claim 31, wherein said frame and glass piece include an adhesive therebetween.

34. The refrigerator shelf as defined in claim 31, wherein said at least two frame portions are said front and rear frame portions.

35. The refrigerator shelf as defined in claim 34, wherein said at least one lower wall of said two frame portions defines a relatively narrow finger.

36. The refrigerator shelf as defined in claim 34, wherein said frame and glass piece include a bond therebetween.

37. The refrigerator shelf as defined in claim 31, wherein said at least two frame portions are said side frame portions.

38. The refrigerator shelf as defined in claim 37, wherein said at least one lower wall of said two frame portions defines a relatively narrow finger.

39. The refrigerator shelf as defined in claim 37, wherein said frame and glass piece include a bond therebetween.

40. The refrigerator shelf as defined in claim 31, wherein said at least one lower wall of said two frame portions defines a relatively narrow finger.

41. The refrigerator shelf as defined in claim 40, wherein said frame and glass piece include a bond therebetween.

42. The refrigerator shelf as defined in claim 31, wherein said at least two frame portions are in spaced opposing relationship to each other.

43. The refrigerator shelf as defined in claim 31, wherein said at least two frame portions are said side frame portions.

44. The refrigerator shelf as defined in claim 31, wherein said at least two frame portions are said side front and rear frame portions.

* * * * *